US006965084B2

(12) United States Patent
Kumasaka et al.

(10) Patent No.: US 6,965,084 B2
(45) Date of Patent: Nov. 15, 2005

(54) MULTIDIRECTIONAL INPUT DEVICE

(75) Inventors: Yoshiaki Kumasaka, Fukushima-ken (JP); Takuya Maeda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/052,421

(22) Filed: Feb. 7, 2005

(65) Prior Publication Data

US 2005/0183937 A1 Aug. 25, 2005

(30) Foreign Application Priority Data

Feb. 20, 2004 (JP) ..... 2004-044935

(51) Int. Cl.[7] ..... H01H 25/04
(52) U.S. Cl. ..... 200/6 A; 200/5 R
(58) Field of Search ..... 200/5 R, 6 A, 200/17 R, 18; 345/161; 273/148

(56) References Cited

U.S. PATENT DOCUMENTS 5,473,325 A * 12/1995 McAlindon ..... 341/20
5,804,781 A * 9/1998 Okabe ..... 200/6 A
6,528,740 B2 * 3/2003 Miyoshi ..... 200/5 R
6,636,197 B1 10/2003 Goldenberg et al.
6,765,165 B1 * 7/2004 Torrens ..... 200/512

FOREIGN PATENT DOCUMENTS

JP 2001-109558 4/2001
WO WO 02/095781 11/2002

* cited by examiner

*Primary Examiner*—Michael A. Friedhofer
(74) *Attorney, Agent, or Firm*—Brinks Hofer Gilson & Lione

(57) ABSTRACT

A driving body is placed on four sets of push switches which are arranged on a concentric circle at equal intervals of 90 degrees. The driving body is pivotally supported by a holder to be rockable, and a driving rod protruding from the driving body is inserted through a square opening formed in the slider, and respective sides of the opening are set parallel to straight lines connecting two sets of adjacent push switches with each other.

3 Claims, 8 Drawing Sheets

MULTIDIRECTIONAL INPUT DEVICE

This application claims the benefit of priority to Japanese Patent Application No. 2004-044935 filed on Feb. 20, 2004, herein incorporated by reference.

BACKGROUND OF THE INVENTION

1. Field of the Invention

The present invention relates to a multidirectional input device for an input operation unit of various kinds of electronic apparatuses. More specifically, the present invention relates to a multidirectional input device in which a slider can be operated on a horizontal plane to detect a signal corresponding to an operating direction of the slider.

2. Description of the Related Art

Generally, a multidirectional input device comprises four sets of push switches mounted on a board at equal intervals of 90 degrees and a driving body rockably disposed above the push switches. The driving body is biased to a neutral position by an elastic force of a return spring built in each push switch or by an exclusive return spring. A driving rod protrudes from the center of the driving body. When an operator operates the driving rod in a predetermined direction to be tilted with his or her hand, the driving body is rocked in the desired direction to turn on the desired push switch.

Conventionally, in a haptic controller with a force feedback function, a multidirectional input device is known in which an operating knob and a motor applying an external force to the operating knob are integrally attached to a slider, and an operator slides the operating knob in a desired direction on the horizontal plane, to rock the driving body by the slider. (Refer to Japanese Unexamined Patent Application Publication No. 2001-109558 (Page 9, FIG. 3A)).

FIG. 9 is a cross-sectional view showing a conventional example of such a multidirectional input device. FIG. 10 is a plan view showing the positional relationship between the slider and the driving body which are included in the conventional multidirectional input device. As shown in FIGS. 9 and 10, a rubber 2 is placed on a printed board 1, and a holder 3 stands at the center of the rubber 2. Four bulging portions 2*a* are integrally formed with the rubber 2, and the bulging portions 2*a* are formed at equal intervals of 90 degrees on a concentric circle P (FIG. 10) centered on the holder 3. A movable contact 4 is formed at the inner bottom of each of the bulging portions 2*a*, and a fixed contact 5 is formed on the printed board 1 so as to face the respective movable contact 4 with predetermined spacing. One set of push switch S is composed of a pair of the movable and fixed contacts 4 and 5, and collectively, four sets of push switches S1 to S4 are arranged around the holder 3 at equal intervals of 90 degrees. As shown in FIG. 10, when X-Y rectangular coordinates having the holder 3 as its origin is set, the push switches S1 and S3 are disposed opposite to each other about the origin on the Y-axis and the push switches S2 and S4 are disposed opposite to each other about the origin on the X-axis. A driving body 5 is placed on the bulging portions 2*a*, and the bottom center of the driving body 5 is pivotally supported by the holder 3. A driving rod 5*a* stands on the top center of the driving body 5, and a base (lower end) of the driving rod 5*a* is formed into a semispherical portion 5*b*. A lower end of a conical portion 6*a*, extending down from a casing 6, abuts an outer peripheral face of the semispherical portion 5*b*. The driving rod 5*a* is inserted through a hole 6*b* in the conical portion 6*a* and extends upward. A slider 7 is disposed above the casing 6 and the slider 7 is horizontally movable integrally with an operating knob (not shown). A circular opening 8 is formed in the slider 7, and the driving rod 5*a* is inserted through the opening 8 and extends beyond the slider 7.

In the multidirectional input device constructed as above, in a non-operating state in which no external force is applied to the operating knob, the driving body 5 maintains neutrality by an upward elastic force from the respective portions 2*a*, and all the respective push switches S1 to S4 are turned off. As shown in FIG. 10, in the non-operating state, the driving rod 5*a* of the driving body 5 is disposed at the center of the opening 8 and an equal width of clearance is secured between the driving rod 5*a* and the opening 8 along the circumference. On the other hand, when an operator moves the slider 7 by the operating knob in any direction, for instance, upward on the Y-axis as shown in FIG. 10, the inner peripheral face of the opening 8 abuts the driving rod 5*a* to rock (tilt) the driving body 5 in the same direction about the holder 3 as its fulcrum, and to buckle the bulging portion 2*a* of the rubber 2 disposed in the same direction. As a result, the movable contact 4 of the push switch S1 contacts the facing fixed contact 5. When the slider 714 is moved in a direction inclined at 45 degrees with respect to the X-Y axis, for instance, in a direction inclined at 45 degrees to the upper right in FIG. 10, the driving body 5 rocks in the same direction about the holder 3 as its fulcrum. As a result, the two sets of push switches S1 and S2 corresponding to the direction are simultaneously turned on. Therefore, by selectively operating four sets of push switches S1 to S4 independently or in pairs, the movement of the slider 7 in eight directions can be detected.

However, in the conventional input device described above, it is difficult to accurately manage the relative position between the driving rod 5*a* of the driving body 5 and the opening 8 of the slider 7. In some cases, the relative position between the driving rod 5*a* and the opening 8 may be changed due to the assembling errors and the dimensional errors of respective members, and as shown in FIG. 11, the driving rod 5*a* may be assembled out of the center of the opening 8. In this case, in a non-actuating state of the slider 7, the driving body 5 is slightly pre-tilted. Thus, for instance, when the slider 7 is moved in a direction inclined at 45 degrees to the upper right, one switch (S1 in this case) of the two bulging portions 2*a* disposed in the desired direction is first turned on. As a result, two sets of push switches S1 to S2 are not simultaneously turned on, which causes an inaccurate detection.

SUMMARY OF THE INVENTION

The present invention has been made in consideration of the above circumstances. Accordingly, it is an object of the present invention to provide a multidirectional input device capable of accurately detecting directions.

In order to achieve the above-mentioned object, a multidirectional input device of the present invention comprises a driving body having a driving rod, a holder rockably supporting the driving body, at least three switch elements being operated with the rocking of the driving body, a board having the switch elements mounted thereon, a slider movable parallel to the board and having an opening through which the driving rod is inserted. The respective switch elements are arranged on a circular arc whose center is a rocking fulcrum of the driving body at substantially equal intervals, and the opening is formed into a polygon having the same number of sides as the switch elements, and the respective sides of the opening are arranged to be substantially parallel to straight lines connecting the respective switch elements with each other and to be opposite to each other about the rocking fulcrum.

In the multidirectional input device, when the slider is moved to the intermediate position between two adjacent switch elements, one side of a polygonal opening is moved parallel to a straight line connecting the switch elements with each other, which are disposed in the desired direction, and abuts the driving rod. Thus, even through a relative position between the driving rod and the driving body is changed, two sets of switch elements can be simultaneously turned on.

In the above construction, although the number of switch elements is not particularly limited as long as at least three switch elements are provided, it is preferable that four switch elements be mounted on the board and the opening be formed into a square. With this multidirectional input device, the movement of the slider in eight directions can be detected by using four switch elements. In this case, a single push switch can be used as each switch element. However, it is desirable that a rubber having four bulging portions be mounted on the board, the driving body be placed on the bulging portions of the rubber, and each of the switch elements is composed of a fixed contact formed on the board and a movable contact formed at an inner bottom of each of the bulging portions.

In the multidirectional input device of the present invention, a polygonal opening having the same number of sides as the switch elements is formed in the slider, and the respective sides of the opening are disposed to be substantially parallel to a straight line connecting two adjacent switch elements with each other and to be opposite to each other about the rocking fulcrum of the driving body. Thus, even though the center of the opening is positioned out of the driving rod of the driving body, when the slider is moved toward the intermediate position between two adjacent switch elements, the two switch elements disposed in a desired direction can be simultaneously turned on. As a result, two directions of the switch elements used can be accurately detected.

DESCRIPTION OF THE PREFERRED EMBODIMENT

Figure 1:
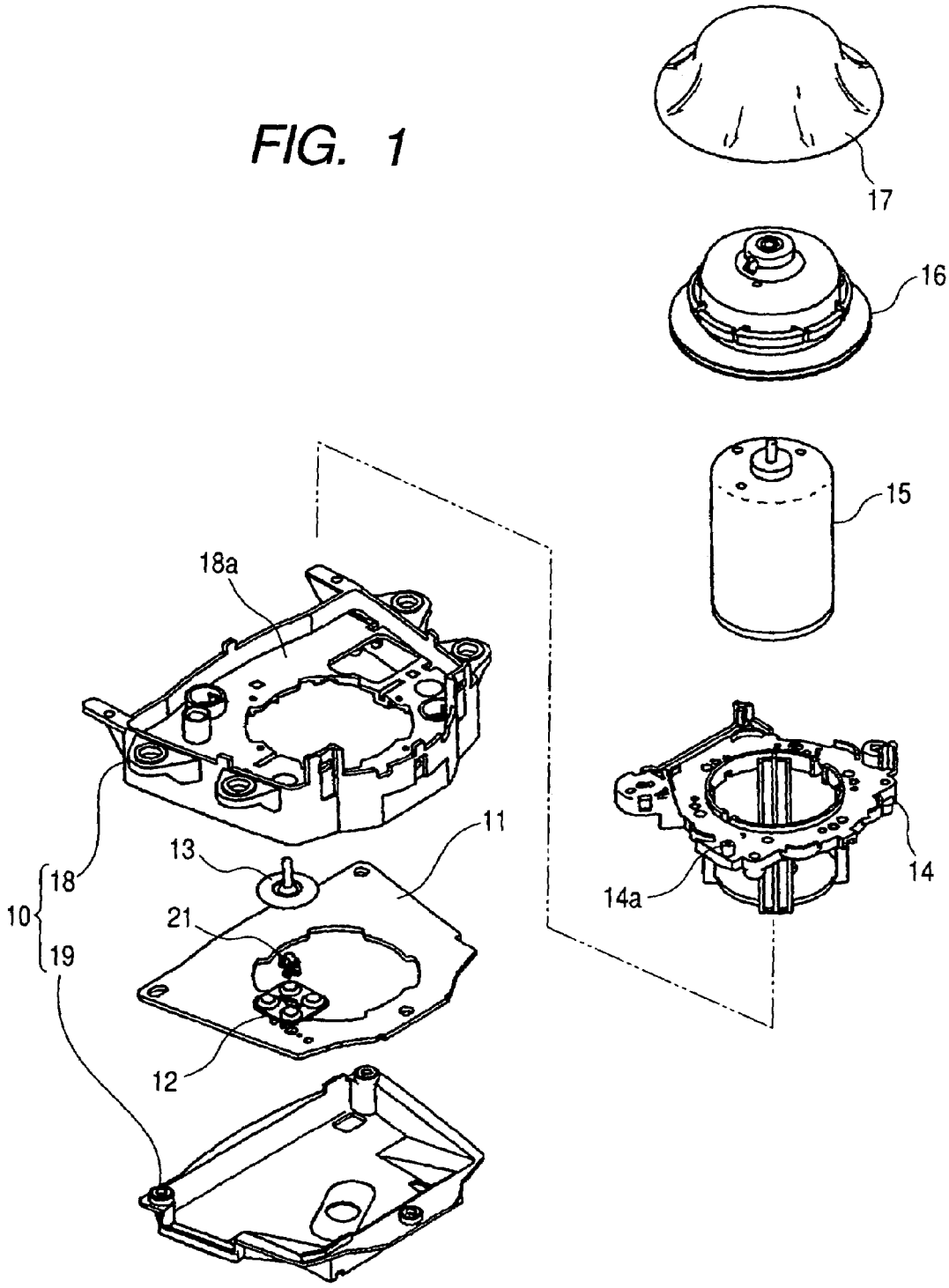
FIG. 1 is an exploded perspective view showing a haptic controller in which a multidirectional input device according to a preferred embodiment of the present invention is incorporated.
Figure 2:
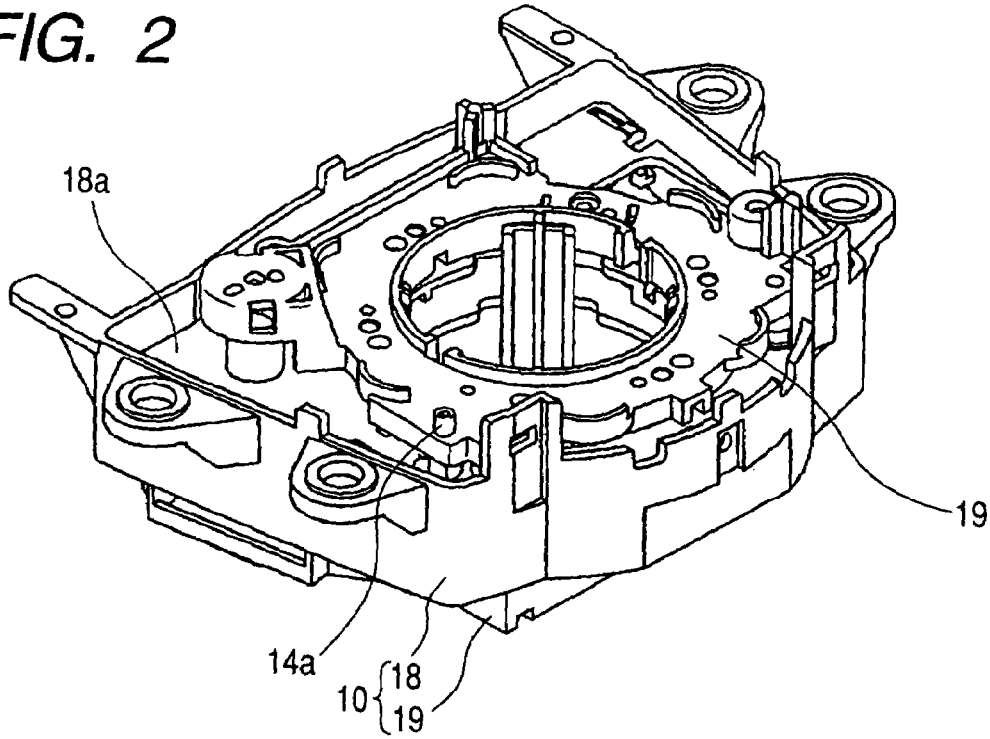
FIG. 2 is a perspective view showing a casing and a slider which are provided in the haptic controller.
Figure 3:
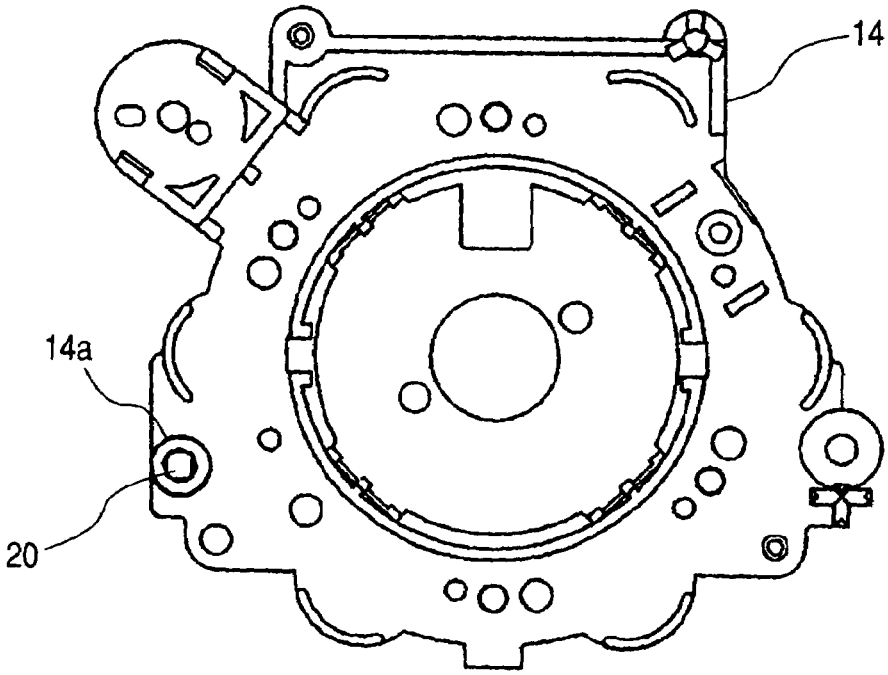
FIG. 3 is a plan view of the slider.

Hereinafter, a preferred embodiment of the invention will be described with reference to the drawings. FIG. 1 is an exploded perspective view showing a haptic controller in which a multidirectional input device according to the preferred embodiment of the present invention is incorporated, FIG. 2 is a perspective view showing a casing and a slider which are provided in the haptic controller, FIG. 3 is a plan view of the slider, FIG. 4 is an exploded perspective view showing essential portions of the multidirectional input device, FIG. 5 is a cross-sectional view of the multidirectional input device, and FIG. 6 is a plan view showing the positional relationship between a driving body and the slider which are provided in the multidirectional input device.

The haptic controller according to FIG. 1 comprises a housing 10 installed inside a console box of a vehicle and the like, a printed board 11 disposed inside the housing 10, a rubber 12 mounted on the printed board 11, a driving body 13 placed on the rubber 12, a slider 14 which is slidably held in the housing 10, a motor 15 fixed on the slider 14, an operating knob 17 connected to a rotating shaft of the motor 15 via an intermediate member 16. The operating knob 17 is exposed to the outside of a panel such as a console box. The housing 10 is composed of a casing 18 and a cover 19, and the casing 18 and the cover 19 are molded of a synthetic resin. As shown in FIG. 2, a partition wall 18*a* is formed inside the casing 18, and the cover 19 is screwed to the bottom of the partition wall 18*a* with the printed board 11 interposed therebetween. The slider 14 is mounted on the top of the partition wall 18*a* and is movable in a direction on a plane parallel to the printed board 11 and the partition wall 18*a*. A cylindrical portion 14*a* stands on the slider 14, and as shown in FIG. 3, an opening 20 having a square shape in plan view is formed in the cylindrical portion 14*a*.

Figure 4:
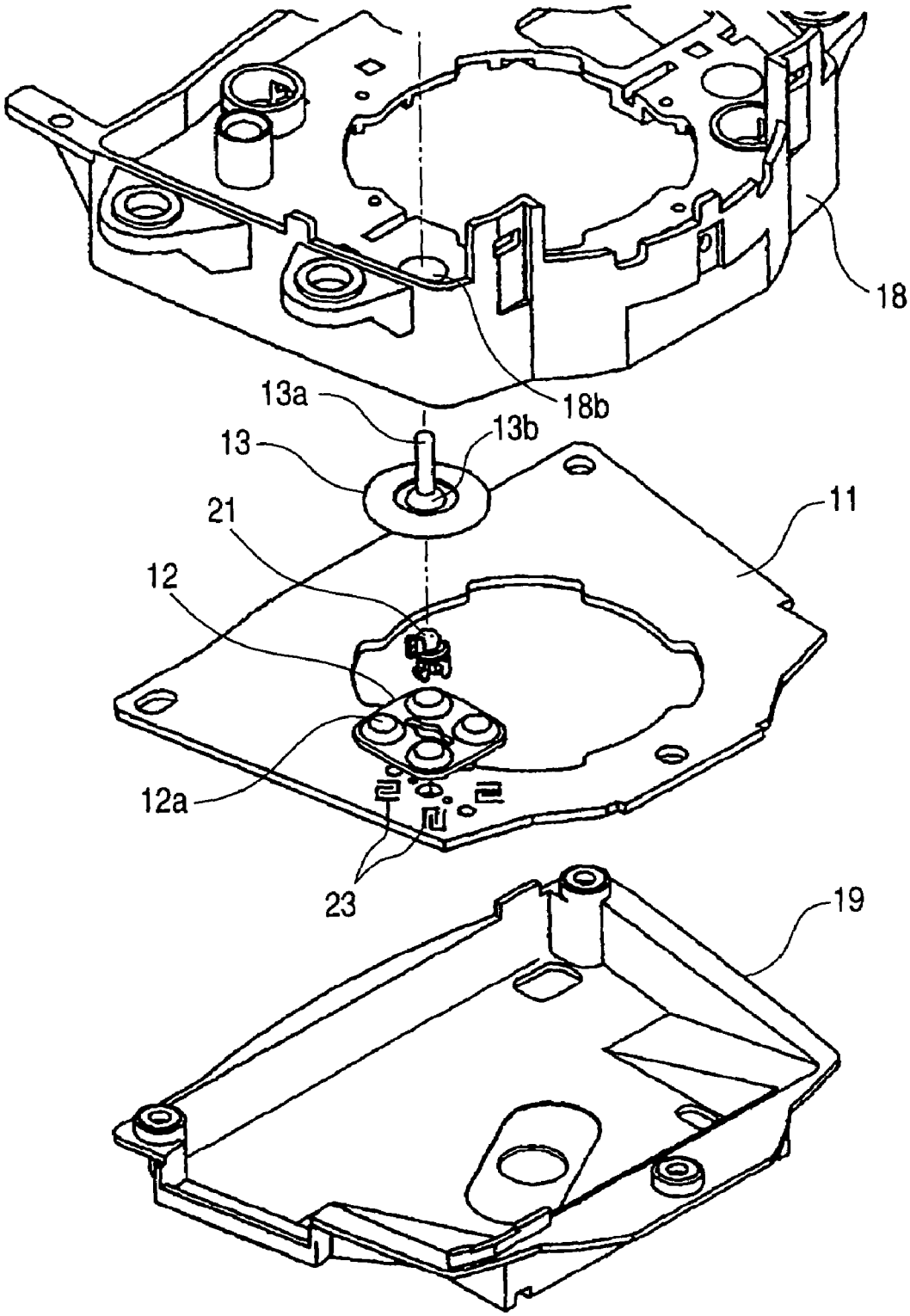
FIG. 4 is an exploded perspective view showing essential portions of the multidirectional input device.
Figure 5:
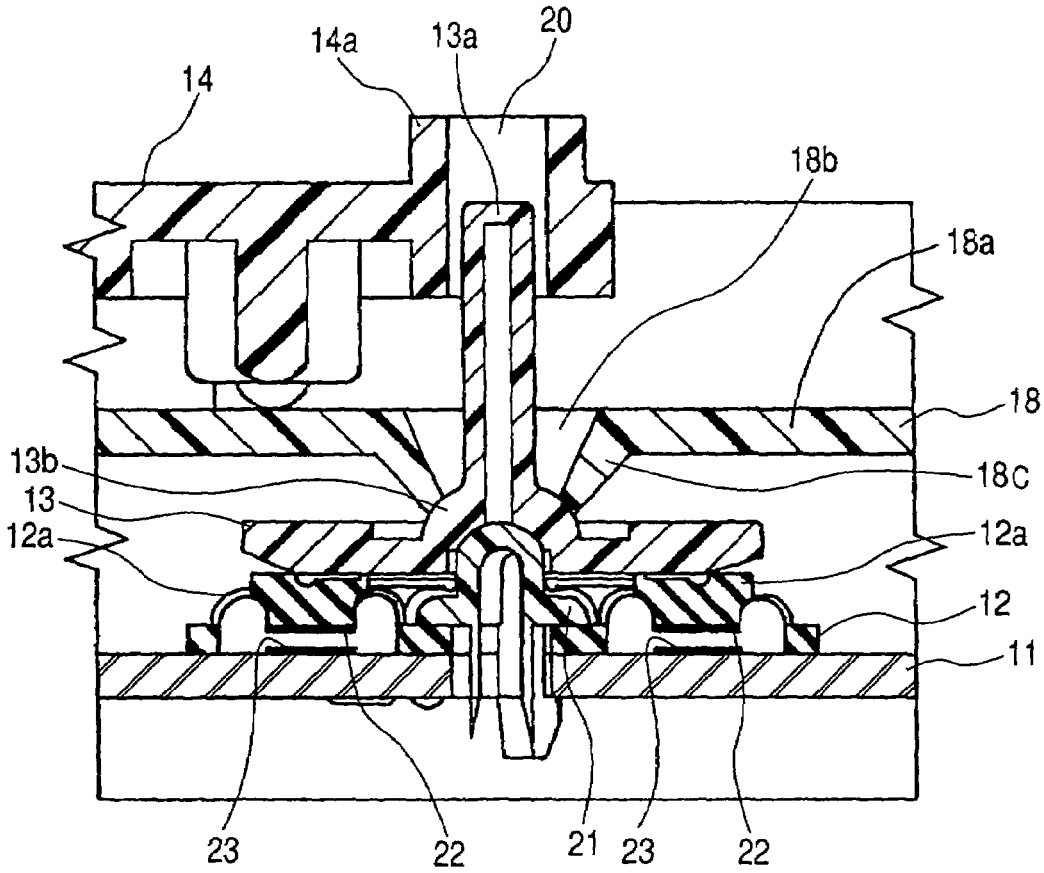
FIG. 5 is a cross-sectional view of the multidirectional input device.

As shown in FIGS. 4 and 5, a holder 21 is snap-fastened on the printed board 11 on which the rubber 12 having four bulging portions 12*a* is placed. A center of the rubber 12 is caught by the holder 21, and the respective bulging portions 12*a* are formed at equal intervals of 90 degrees on a concentric circle P (FIG. 6) centered on the holder 21. A movable contact 22 is formed at the inner bottom of each of the bulging portions 12*a*, and a fixed contact 23 is formed on the printed board 11 so as to face the movable contact 22 with predetermined spacing. One set of push switch S is composed of a pair of the movable and fixed contacts 22 and 23, and collectively, four sets of push switches S1 to S4 are arranged around the holder 21 at equal intervals of 90 degrees. The driving body 13 is placed on the bulging portions 12*a* of the rubber 12 and the bottom center of the driving body 13 is pivotally supported by the holder 21. A driving rod 13*a* stands on the top center of the driving body 13, and a base (lower end) of the driving rod 13 is formed into a semispherical portion 13*b*. A lower end of a conical portion 18*c*, extending down from the casing 18, abuts the outer peripheral face of the semispherical portion 13*b*, and the driving body 13 is sandwiched between the holder 21 and the conical portion 18*c*. The driving rod 13*a* is inserted through a hole 18*b* in the conical portion 18*c* and extends upward and an upper end of the driving rod 13*a* extends beyond the opening 20 of the slider 14.

Figure 6:
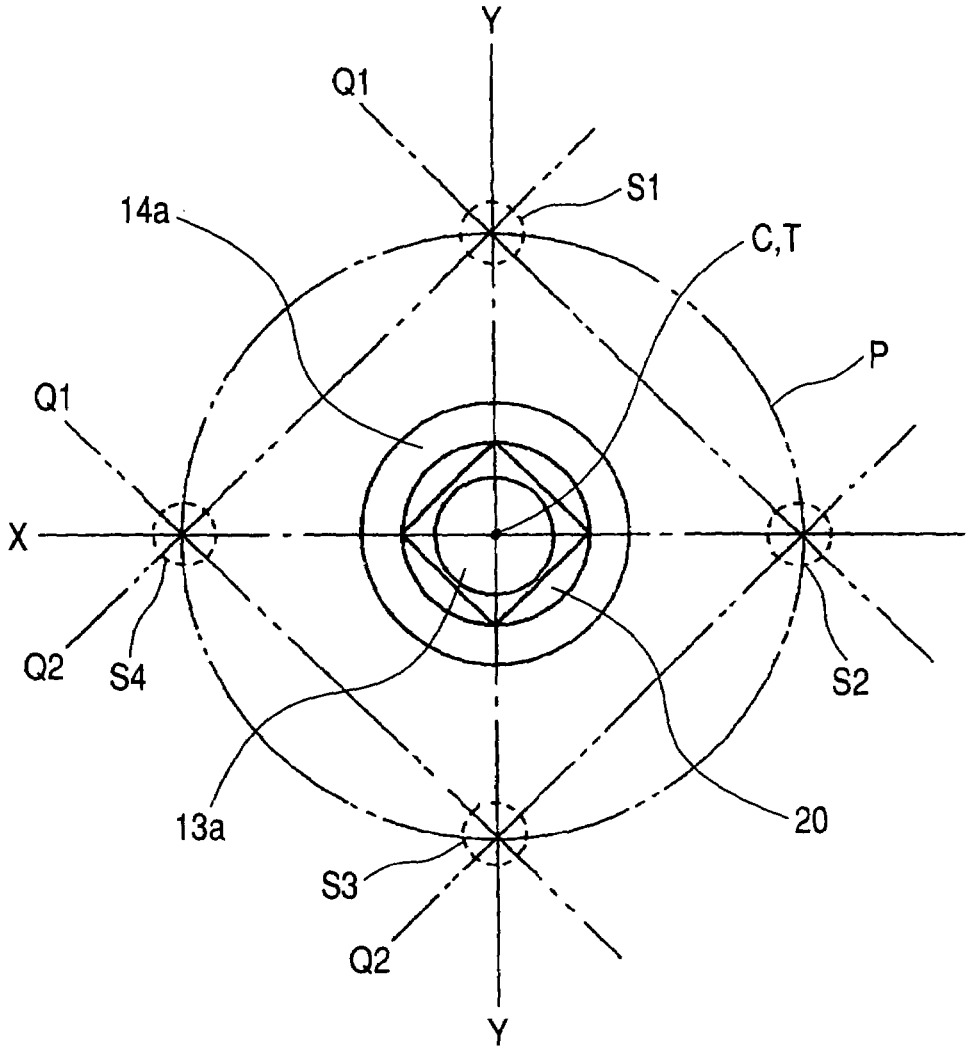
FIG. 6 is a plan view showing the positional relationship between a driving body and the slider which are provided in the multidirectional input device.

As shown in FIG. 6, when X-Y rectangular coordinates, which have the center C of the concentric circle P as its origin, is set, the push switches S1 and S3 are disposed opposite to each other about the origin on the Y-axis C and the push switches S2 and S4 are disposed opposite to each other about the origin on the X-axis C. Corners of the opening 20 formed in the slider 14 are respectively disposed on the X-Y axis, and the driving rod 13*a* of the driving body 13 inserted through the opening 20 is disposed on the origin. Namely, two mutually facing sides of the opening 20 are set parallel to a straight line Q1 which connects the push switches S1 and S2 (or the push switches S3 and S4) with each other, and the remaining sides of the opening 20 are set parallel to a straight line Q2 which connects the push switches S1 and S4 (or the push switches S2 and S3) with each other. Furthermore, in this state, the position of a rocking fulcrum T of the driving body 13 is the same as that of the origin C.

Figure 7A:
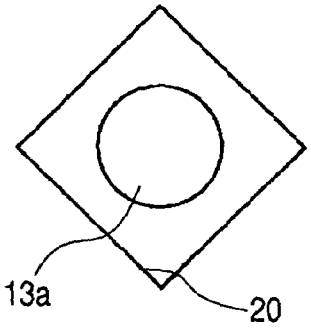
FIG. 7 is an explanatory view for explaining the operation between an opening of the slider and a driving rod of the driving body.
Figure 7B:
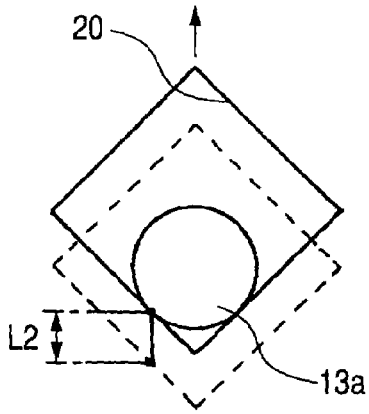
Figure 7C:
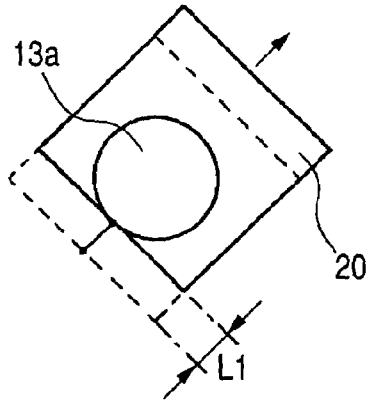

In the multidirectional input device constructed as above, in a non-operating state in which any external force is not applied to the operating knob 17, the driving body 13 maintains neutrality by an upward elastic force from the respective portions 12*a* of the rubber 12 and all the respective push switches S1 to S4 are turned off. As shown in FIG. 7A, in such a non-operating state, the driving rod 13*a* is disposed on the center of the opening 20 and a clearance having a length L1 is secured between the driving rod 13*a* and the respective sides of the opening 20. When an operator moves the slider 14 by the operating knob 17 from a non-operating state to any one of four directions parallel to the X-Y axis, for instance, upward on the Y-axis as shown in FIG. 6, as shown in FIG. 7B, two lower sides of the opening 20 simultaneously abut the driving rod 13*a* and push the driving rod 13*a*. Thus, the driving body 13 rocks in the same direction about the holder and buckles the bulging portion 12*a* of rubber 12 disposed in the same direction. As a result, the movable contact 22 of the push switch S1 abuts the facing fixed contact 23 and turns the push switch S1 on. When the slider 14 is moved in three other direction parallel to the X-Y axis, the same process follows. The movement of the slider 14 in four directions parallel to the X-Y axis can be detected when the respective push switches S1 to S4 are independently switched on. When the slider 14 is moved in a direction inclined at 45 degrees with respect to the X-Y axis, for instance, in a direction inclined at 45 degrees to the upper right as shown in FIG. 6, a lower left side of the opening 20 abuts the driving rod 13*a* and pushes the driving rod 13*a* as shown in FIG. 7C. Thus, the driving body 13 rocks in the same direction about the holder 21 as its fulcrum and buckles two bulging portions 12*a* of the rubber 12 disposed in the same direction. As a result, the two sets of push switches S1 and S2 corresponding to the bulging portion 12*a* are turned on. Even when the slider 14 is moved in three other directions inclined at 45 degrees with respect to the X-Y axis, the same process follows. As such, the movement of the slider 14 in the four directions inclined at 45 degrees with respect to the X-Y axis can be detected by simultaneously switching on the two sets of respective push switches S1 to S4. Therefore, in addition to the detection of movement of the slider in four directions parallel to the X-Y axis, a total of the slider 14 in eight directions can be detected.

Here, when one set of the push switch is turned on by moving the slider 14 in the direction parallel to the X-Y axis, as shown in FIG. 7B, the distance L2 by which the slider 14 moves until two adjacent sides of the opening 20 abut the driving rod 13*a* is about 1.4 times the aforementioned clearance length L1 ($L2=L1\times\sqrt{2}$), and the distance from the rocking fulcrum T of the driving body 13 to points of action of the respective push switches S1 to S4, becomes equal to the radius of the concentric circle P. To the contrary, when two sets of push switches are simultaneously turned on by moving the slider 14 in the direction inclined at 45 degrees with respect to the X-Y axis, as shown in FIG. 7C, the distance by which the slider 14 move until one side of the opening 20 abuts the driving rod 13*a* becomes L1 which is shorter than the distance L2. However, the length of perpendicular lines drawn to the straight lines Q1 and Q2 from the rocking fulcrum T of the driving body 13 becomes $1/\sqrt{2}$ of the radius of the concentric circle P, which is shorter than the radius. Thus, the distance by which the slider 14 moves until the driving rod 13*a* starts moving and two sets of the push switches are turned on is increased. Accordingly, the stroke of the slider 14 which is required to turn on one set of push switch independently is almost the same as that required to turn on two sets of push switches simultaneously. As a result, the operational disparity that different strokes are required depending on directions of movement of the slider 14 can be removed.

Figure 8A:
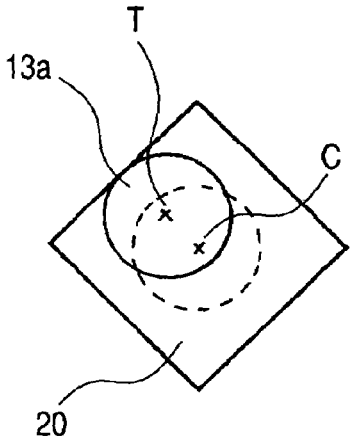
FIG. 8 is an explanatory view for showing the operation when a relative position between the opening and the driving rod is changed.
Figure 8B:
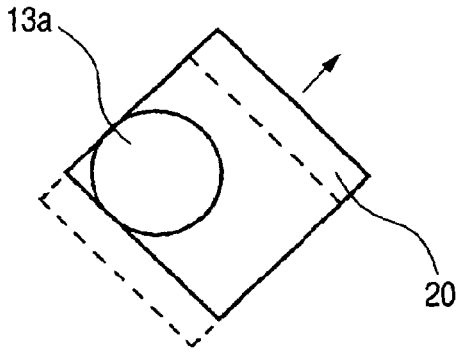
Figure 9:
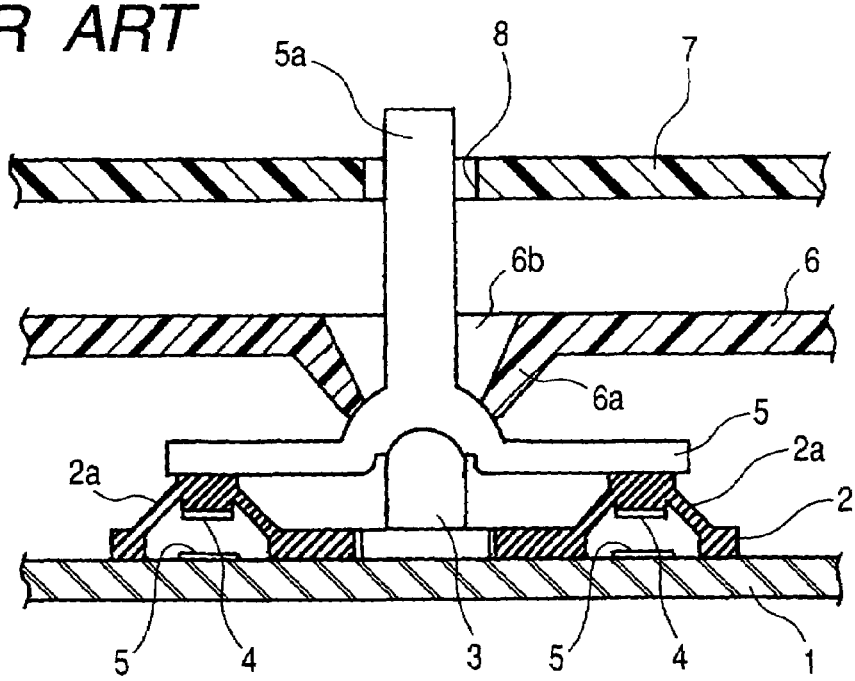
FIG. 9 PRIOR ART
FIG. 9 is a cross-sectional view showing a multidirectional input device according to a conventional input device.
Figure 10:
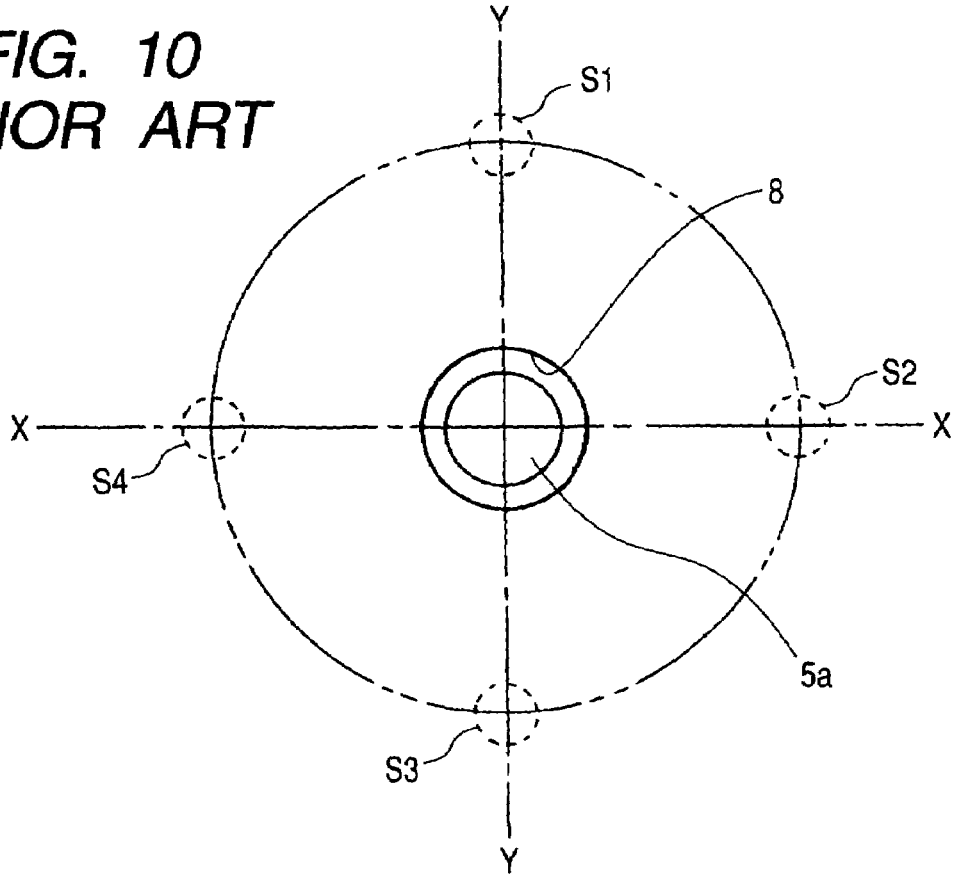
FIG. 10 PRIOR ART
FIG. 10 is a plan view showing the positional relationship between the slider and the driving body which are provided in the conventional multidirectional input device.
Figure 11:
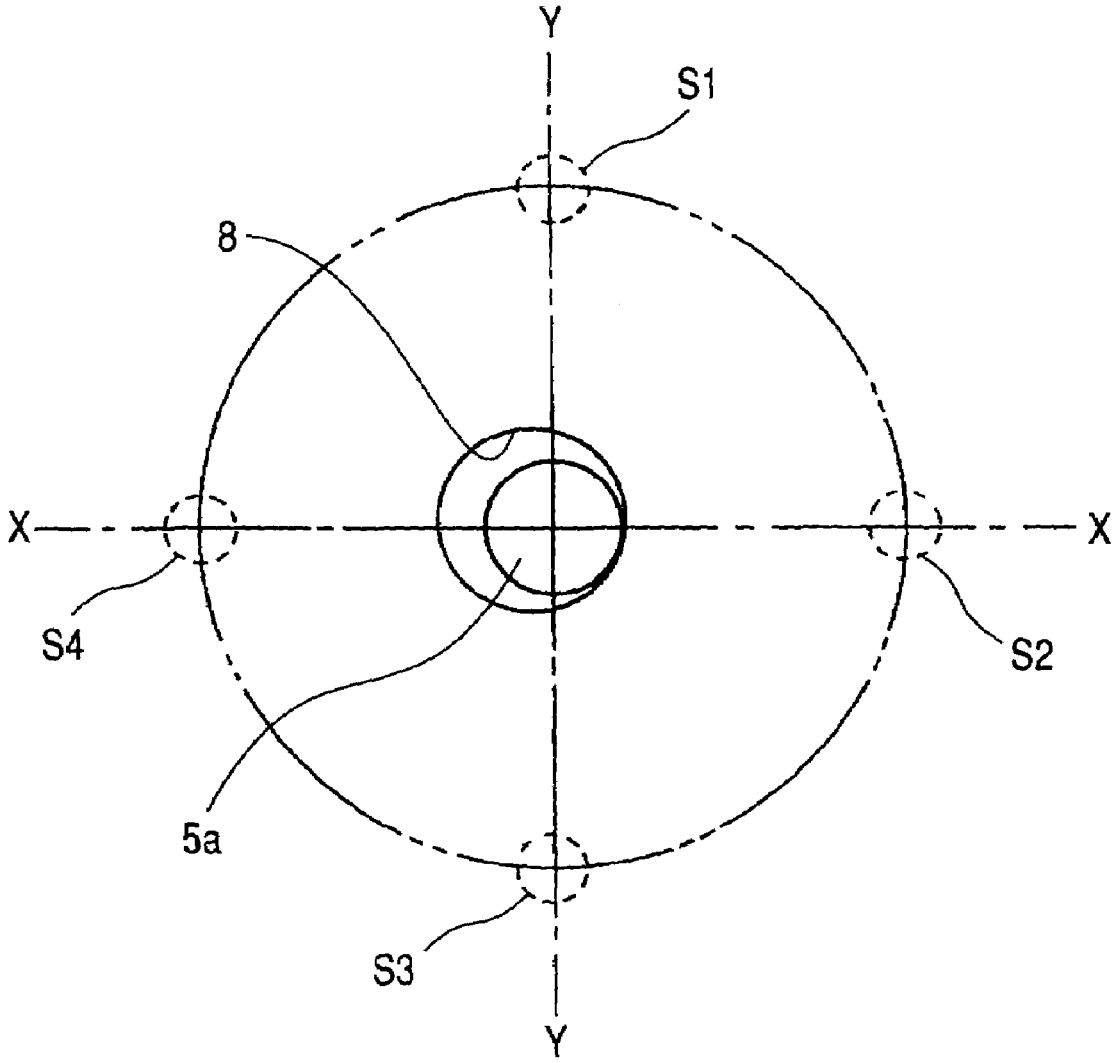
FIG. 11 PRIOR ART
FIG. 11 is an explanatory view demonstrating problems of the conventional multidirectional input device.

In the multidirectional input device constructed as above, the relative position between the driving rod 13*a* and the opening 20 may be changed due to assembling errors and dimensional errors of respective members including the slider 14 and the casing 18, and as shown in FIG. 8A, for instance, the driving rod 13*a* may be assembled in a biased state to one side out of the center (the origin C) of the opening 20. In this case, in a non-operating state of the slider 14, the driving body 13 is slightly pre-tilted. However, as shown in FIG. 8B, when the slider 14 is moved in a direction inclined at 45 degrees with respect to the X-Y axis, a side of the opening 20 which extends in a direction orthogonal to the moving direction abuts the driving rod 13*a* to rock the driving body 13. Thus, two sets of the push switches disposed in the direction are turned on simultaneously. Therefore, when the slider 14 is moved in a direction inclined at 45 degrees with respect to the X-Y axis, detection errors such as that an one push switch is first turned on can be prevented, and the movement of the slider 18 in eight directions can be accurately detected by using four sets of the push switches S1 to S4.

Although the preferred embodiment of the present invention has been described about the case in which the multidirectional input device of the present invention is applied to an onboard haptic controller, it is needless to say that the present invention can be applied to electronic apparatuses (for example, a game machine) other than the haptic controller.

What is claimed is:

1. A multidirectional input device comprising:

a driving body having a driving rod;

a holder rockably supporting the driving body;

at least three switch elements being operated with the rocking of the driving body;

a board having the switch elements mounted thereon; and a slider movable parallel to the board and having an opening through which the driving rod is inserted;

wherein the respective switch elements are arranged at substantially equal intervals on a circular arc whose center is a rocking fulcrum of the driving body, the opening is formed into a polygon having the same number of sides as the number of the switch elements, and the respective sides of the opening are arranged to be substantially parallel to straight lines connecting the respective switch elements with each other and to be opposite to each other about the rocking fulcrum.

2. The multidirectional input device according to claim 1, wherein four switch elements are mounted on the board and the opening is formed into a square.

3. The multidirectional input device according to claim 2, wherein a rubber having four bulging portions is mounted on the board, the driving body is placed on the bulging portions of the rubber, and each of the switch elements is composed of a fixed contact formed on the board and a movable contact formed at an inner bottom of each of the bulging portions.

* * * * *